US008365349B2

(12) United States Patent
Takeda et al.

(10) Patent No.: US 8,365,349 B2
(45) Date of Patent: Feb. 5, 2013

(54) SUCTION DEVICE FOR POWERED APPARATUS

(75) Inventors: Masaki Takeda, Ohme (JP); Yoshiki Nakayama, Akishima (JP)

(73) Assignee: Yamabiko Corp., Tokyo (JP)

( * ) Notice: Subject to any disclaimer, the term of this patent is extended or adjusted under 35 U.S.C. 154(b) by 172 days.

(21) Appl. No.: 12/216,560

(22) Filed: Jul. 8, 2008

(65) Prior Publication Data

US 2009/0083933 A1 Apr. 2, 2009

(30) Foreign Application Priority Data

Sep. 27, 2007 (JP) ..... 2007-251827

(51) Int. Cl.
*A47L 5/00* (2006.01)
*A47L 9/00* (2006.01)
*B02C 23/00* (2006.01)

(52) U.S. Cl. ..... 15/327.2; 241/53; 241/55; 241/56; 241/58

(58) Field of Classification Search ..... 15/327.2; 241/53, 55, 56, 58
See application file for complete search history.

(56) References Cited

U.S. PATENT DOCUMENTS

| | | | | |
|---|---|---|---|---|
| 2,340,457 | A * | 2/1944 | Dion | 241/55 |
| 2,733,000 | A * | 1/1956 | Sparklin | 241/55 |
| 4,325,163 | A * | 4/1982 | Mattson et al. | 15/330 |
| 4,955,107 | A * | 9/1990 | Kawai | 15/339 |
| 5,358,189 | A * | 10/1994 | Vandermolen | 241/92 |
| 5,381,970 | A * | 1/1995 | Bold et al. | 241/55 |
| 5,860,606 | A * | 1/1999 | Tiedeman et al. | 241/55 |
| 6,368,066 | B2 | 4/2002 | Aiyama et al. | |

FOREIGN PATENT DOCUMENTS

JP 3-58604 6/1989

OTHER PUBLICATIONS

English Abstract of JP01-223205 (3-58604), Sep. 1989.

* cited by examiner

*Primary Examiner* — Bryan R Muller
(74) *Attorney, Agent, or Firm* — Dykema Gossett PLLC

(57) ABSTRACT

To avoid sandwiching of a sucked object in a gap between an inner wall of a fan case and a fan of a hand-held suction apparatus, an entering regulation part is positioned to extend into the air intake opening to return sucked objects back into the air intake opening and prevent sandwiching in the gap.

2 Claims, 4 Drawing Sheets

SUCTION DEVICE FOR POWERED APPARATUS

BACKGROUND OF THE INVENTION

1. Field of the Invention

The present invention relates to a suction device for a powered vacuum apparatus.

2. Description of the Related Art

A hand-held, powered vacuum apparatus which draws in garden debris such as leaves and a dust by using a suction pressure of a centrifugal blower to collect the debris into a bag or the like that is attached to a blowing tip is known. FIG. 1 shows an example of a conventional hand-held powered vacuum apparatus (refer to Japanese Laid-Open No. 2000-179497; FIG. 1A is an external view and FIG. 1B is a front view of a fan case).

In this conventional example, a main body 1 is integrally formed by a motor 11 for driving a fan 10, a recoil starter 12 for starting, a fuel tank 13, and a fan case 14 or the like. A suction pipe 2 is detachably coupled with an air intake opening 14A of a fan case 14 and a blowing pipe 3 is detachably coupled with an air blowing opening 14B of the fan case 14. A dust bag 4 having suitable ventilation property is attached to a blowing end of the blowing pipe 3. The example shown in the drawing is a hand-held apparatus and handles 15 and 16 gripped by an operator are mounted on the main body 1. In addition, in the air intake opening 14A of the fan case 14, a cutter 5 is provided, which is placed on a driving axis of the fan 10 to be rotated with the fan 10.

According to such hand-held powered vacuum apparatus, the fan 10 is driven due to start of the motor 11, and a garden debris such as fallen leaves, wood chips, and dust is drawn into the air intake opening 14A of the fan case 14 via the suction pipe 2 due to a suction pressure caused by blowing from the fan 10. Therefore, the debris is crushed by the cutter 5 to be rotated with the fan 10 and the crushed debris is transferred to the air blowing opening 14B passing through an air intake passage in the fan case 14 to be collected in the dust bag 4 via the blowing pipe 3.

In order to obtain a desired suction property, it is necessary for such a suction device for powered vacuum apparatus to provide a gap formed between a wing top part of the fan 10 and the inner wall of the fan case 14. If this gap is made too narrow, a drive load of the fan is made larger, and if this gap is made too wide, a suction force cannot be effectively generated.

Therefore, setting the above-described gap in order to obtain a desired suction property, a bar-shaped wood chip such as a branch and a plate-shaped wood chip or the like crushed by the cutter 5 into a thickness that they are easily sandwiched in the gap or a wood chip or the like originally having a thickness to be easily sandwiched in the gap, which slip through the cutter 5, may enter from the periphery of the air intake opening 14A into the inside of the fan case 14. Then, this involves a problem such that the wood chips which slip through the cutter 5 are sandwiched in the gap between the inner wall of the fan case 14 and the fan 10.

Thus, if the debris is sandwiched in the gap between the inner wall of the fan case 14 and the fan 10, the fan is locked according to the circumstance and this makes it impossible to continue the suction work. In addition, in the case that a relatively-narrow debris is sandwiched, the rotation of the fan 10 is continued with a foreign object sandwiched in the gap, so that the rotation of the fan 10 is prevented by friction and a desired suction property cannot be obtained. In the case of carrying out the operation in such a condition for a long period of time, it may be considered that the blade of the fan 10 and the inner wall of the fan case 14 are damaged.

Even if the front end of the cutter is elongated so as to be closer to the inner wall of the fan case 14, there is no effect on the wood chip or the like slipping through the cutter 5 since the crushing is not enough. Therefore, for this problem, a suggestion as described in the following Japanese Patent Application Publication No. 3-58604 is made, for example. According to this document, setting a fixed cutter blade on a part of the air intake opening 14A for the rotational cutter blade as the above-described cutter 5, the debris that is easily sandwiched between the inner wall of the fan case 14 and the fan 10 is further cut depending on a cooperation between the rotational cutter blade and the fixed cutter blade.

SUMMARY OF THE INVENTION

However, according to a conventional art to provide a fixed cutter blade to the above-described rotational cutter blade, in the case that a hard sucked object such as a pebble is sucked, there is a problem such that this hard sucked object is sandwiched between the rotational cutter blade and the fixed cutter blade so as to damage or break the rotational cutter blade and the fixed cutter blade. In order to solve this problem, it is absolutely necessary to provide a safety mechanism for letting the fixed cutter blade loose by a spring or the like when an excessive load acts between the rotational cutter blade and the fixed cutter blade. Thereby, a structure of the device becomes complex and a problem such that a maintenance performance is deteriorated and a manufacturing cost of the device is increased is caused. In addition, if a spring or the like is used, the debris is sandwiched between the springs, and this involves a problem such that the reliability of the safety mechanism is decreased.

An object of the present invention is to overcome these problems. In other words, in the suction device for powered vacuum apparatus using a suction pressure of a centrifugal air blower, the object of the present invention is as follows, namely, to avoid the phenomenon that the debris is sandwiched between the inner wall of the fan case and the fan; to enable to continue a stable work by avoiding the above-described phenomenon such that the debris is sandwiched between the inner wall of the fan case and the fan and to prevent a damage of the fan and the fan case so as to improve a durability of the device; and to enable to provide a safety suction device for powered vacuum apparatus with an excellent maintenance performance and a low manufacturing cost by avoiding the above-described clogging phenomenon without providing a fixed cutter blade and a safety mechanism to be added to the fixed cutter blade or the like.

Means for Solving Problem

In order to attain these objects, the suction device according to the present invention is provided with at least the structure according to following structure.

[Structure 1]

A suction device for powered vacuum apparatus having an air intake opening formed along a driving axis of a fan in a fan case and having an air blowing opening formed along a centrifugal direction of the fan for blowing a sucked object sucked from the air intake opening into the fan case from the air blowing opening, characterized in that: an entering regulation part for regulating entering of the sucked object into a gap between the inner wall of the fan case and the fan is formed on a part of the periphery of the air intake opening.

According to such a characteristic, if the sucked object drawn into the air intake opening intends to enter the gap between the inner wall of the fan case and the fan, the sucked object is turned by the above-described entering regulation part to be returned into the air intake opening again. By repeating this, changing a guide path through which the sucked object is drawn, the sucked object is lead to the air intake opening passing through among the blades of the fan, so that it is possible to avoid the phenomenon such that the sucked object is sandwiched between the inner wall of the fan case and the fan.

The entering regulation part is formed on a part of the periphery of the air intake opening, so that it is possible to make the influence in minimum on the air current passing through the gap between the inner wall of the fan case and the fan and the suction property of the fan is not lowered. Here, a part of the periphery of the air intake opening is not limited to one place and it may be formed on plural places. As a result, the entering regulation part may be partially formed for the entire periphery of the air intake opening.

Thereby, the present invention makes it possible to avoid the phenomenon such that the sucked object is sandwiched between the inner wall of the fan case and the fan; to enable to continue a stable action, and to improve a durability of the device by preventing a damage of the fan and the fan case. In addition, clogging of the sucked object can be avoided without providing a fixed cutter blade and a safety mechanism to be added to the fixed cutter blade, so that it is possible to obtain a safety suction device for powered vacuum apparatus with an excellent maintenance performance and a low manufacturing cost.

DESCRIPTION OF THE PREFERRED EMBODIMENTS

Figure 1A:
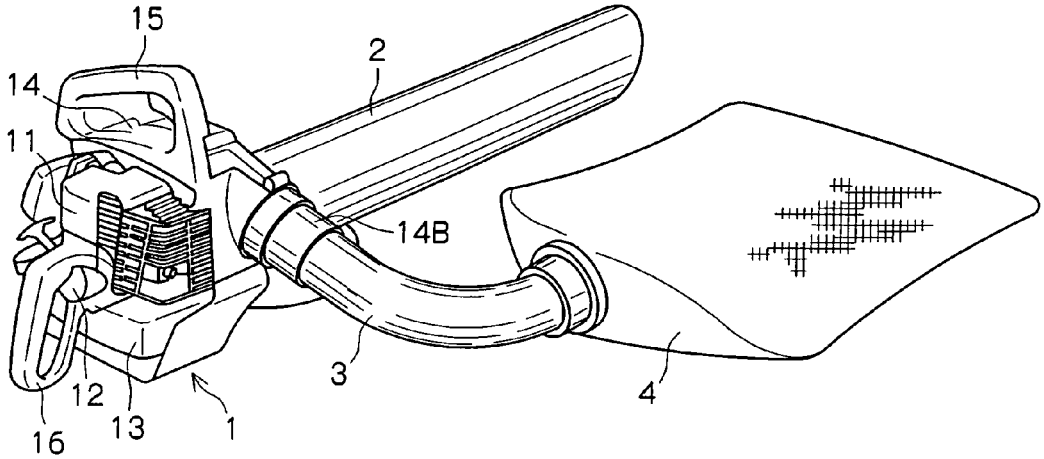
FIG. 1A (PRIOR ART)
FIGS. 1A and 1B are explanatory views showing a conventional suction device, FIG. 1A being an perspective view and FIG. 1B being a front view of a fan case.
Figure 1B:
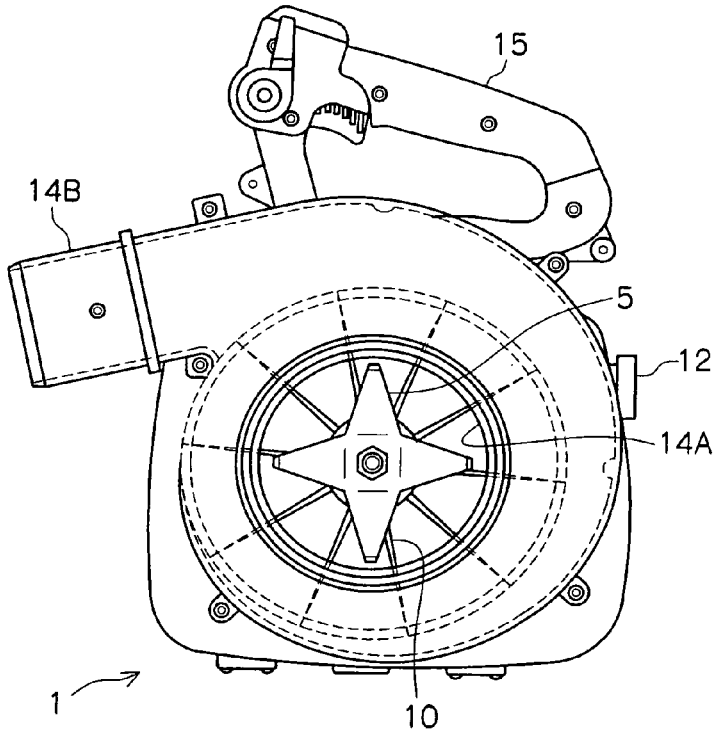
FIG. 1B (PRIOR ART)

Hereinafter, the embodiments of the present invention will be described with reference to the drawings. A suction device for powered vacuum apparatus according to the embodiments of the present invention may include a structure of the conventional art shown in FIG. 1 as a premise. However, the present invention is not particularly limited to this formation but it may be provided with a fan 10, a driving device for driving the fan (for example, a motor 11), a fan case 14, an air intake opening 14A formed in the fan case 14, and an air blowing opening 14B as a constitutional member that is a premises (according to the embodiment of the present invention, the elements in common with the conventional art are given the reference numerals and marks of FIG. 1). In other words, the suction device according to an embodiment of the present invention has an air intake opening 14A formed along a driving axis 20 of a fan 10 in a fan case 14 and has an air blowing opening 14B formed along a centrifugal direction of the fan 10, and the suction device blows a sucked object sucked from the air intake opening 14A into the fan case 14 from the air blowing opening 14B.

Figure 2A:
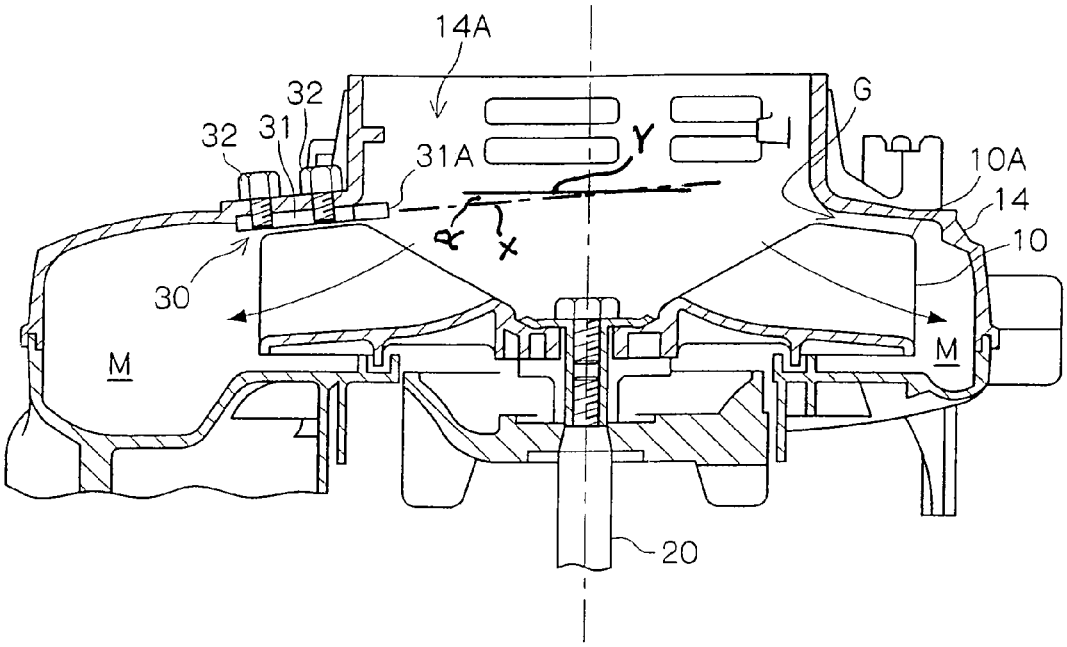
FIGS. 2A and 2B are explanatory views of an embodiment of the present invention, FIG. 2A being a substantial part cross sectional view and FIG. 2B being a plan view of an entering regulation member.
Figure 2B:
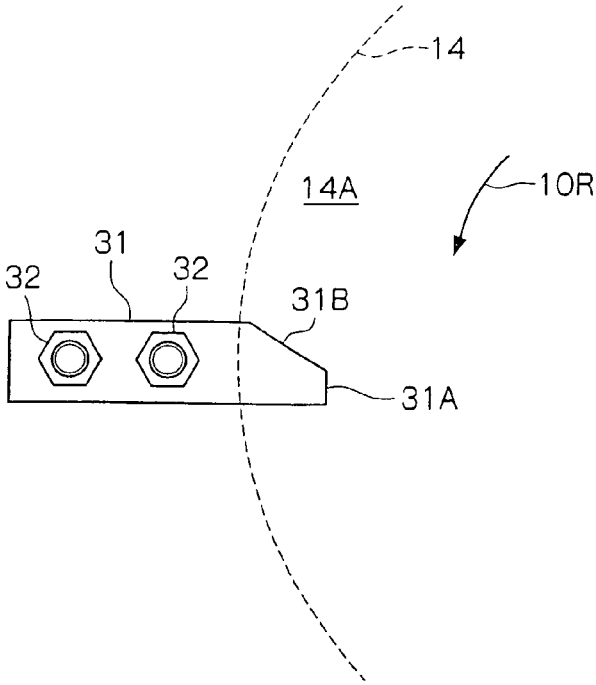

FIGS. 2A and 2B are explanatory views explaining a substantial part of the suction device according to an embodiment of the present invention. FIG. 2A is a substantial part cross sectional view and FIG. 2B is a plan view of an entering regulation member. In the drawing, in the fan case 14, an air inlet duct 14A forms an air intake (inlet) opening 14A' along the driving axis 20 (the output axis of the motor). The driving axis 20 drives the fan 10 and the sucked object sucked up to the air intake opening 14A by a suction pressure generated by the rotational driving of the fan 10 is guided to an air intake passage M in the fan case 14 passing through among the wings of the fan 10 as shown by an arrow to be blown from the air blowing opening 14B (not illustrated in FIG. 2A) that is formed in a centrifugal direction of the fan 10.

An annular gap G having a set interval is formed between a blade top part 10A of the fan 10 and the inner (front) wall 14C of the fan case 14 around the air intake opening 14A in the fan case 14. The annular gap G is generally perpendicular to the driving axis 20. If the sucked obstacle such as a wood chip enters this gap G, this sucked obstacle is sandwiched between the wing top part 10A and the inner (front) wall of the fan case 14 and this involves a problem such that the above-described problem is caused. A rear wall 14D is opposite front wall 14C.

In the embodiment of entering regulation member the present invention, on a part of the periphery of the air intake opening 14A, an entering regulation part 30 for regulating entering of the sucked object into the gap G is formed. According to the illustrated example, the entering regulation part 30 is formed by an entering regulation member (elongated element) 31 that is attached to the inner (front) wall 14C of the fan case 14 around the air intake opening 14A. In this example, the entering regulation member 31 abutting against the inner wall of the fan case 14 is attached from the outside of the fan case 14 by means of a fixing device (bolts) 32. Not limited to this example, the entering regulation part 30 may be formed in such a manner that a partially-concave part is formed in the inner wall of the fan case 14 so as to fill the gap G by a part of the periphery of the air intake opening 14A. The entering regulation part 30 extends towards axis 20 and away from rear wall 14D of fan case 14 along a plane X that intersects axis 20 at an angle $\alpha$ relative to a plane Y that is perpendicular to axis 20.

The entering regulation part 30 does not cut or crush the sucked object such as a wood chip by itself. The entering regulation part 30 has a function to turn the sucked object intending to enter the gap G and return it into the air intake opening 14A. Forming this entering regulation part 30 only in one place around the air intake opening 14A, a sufficient function can be obtained. However, within a scope that the suction performance of the fan 10 is not lowered, the entering regulation part 30 may be formed on plural places around the air intake opening 14A. If the entering regulation part 30 is formed on one place around the air intake opening 14A, the sucked object such as a wood chip to enter the gap G intend to enter the gap G while moving around the air intake opening 14A in accordance with rotation of the fan 10, so that the sucked object crushes into the entering regulation part 30 during movement so as to be turned within the air intake opening 14A. When the sucked object intending to enter the gap G is turned within the air intake opening 14A, this sucked object intends to pass through other suction passage. Therefore, during repeating this, the sucked object is drawn into the fan case 14 passing through the suction passage between the fans 10, and this makes it possible to avoid the phenomenon such that a wood chip or the like is sandwiched in the gap G.

In the case that the entering regulation part 30 is formed by the entering regulation member 31, as shown in the drawing, by making the front end 31A to protrude into the air intake opening 14A, it is possible to further enhance the entering regulation effect. If the front end 31A of the entering regulation member 31 is made to protrude into the air intake opening 14A according to need, the sucked object such as a wood chip getting close to the gap G can be turned into the air intake opening 14A, so that entering of the sucked object into the gap G can be prevented in a former stage in advance. Thereby, a ratio that the sucked object is sandwiched in the gap G can be kept very low.

In addition, in the entering regulation member 31, which is seen to be generally rectangular, a turning part (straight portion) 31B which is sloped relative to sides of the regulation element and directed toward the inside of the air intake opening 14A to be opposed to a rotation direction of the fan 10 (an arrow 10R) may be formed on its front end 31A according to need. By forming this turning part 31B, the sucked object can be prevented from being sandwiched can be further enhanced. In other words, the sucked object such as a wood chip abutting against the turning part 31B is reliably redirected into the air intake opening 14A, so that the sucked object which would otherwise become sandwiched can be effectively guided to other suction passage. Thereby, it is possible to avoid the sucked object from being sandwiched in the gap G.

Figure 3A:
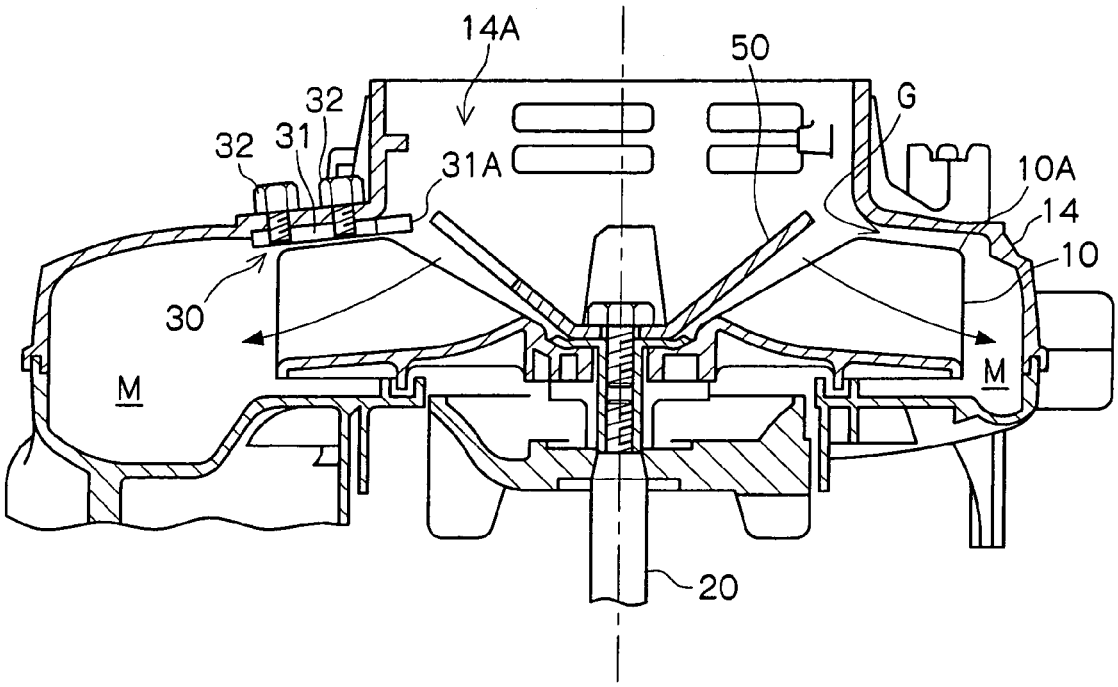
FIGS. 3*a* and 3B are explanatory views of another embodiment of the present invention, FIG. 3A being a substantial part cross section view and FIG. 3B being a plan view of an entering regulation member.
Figure 3B:
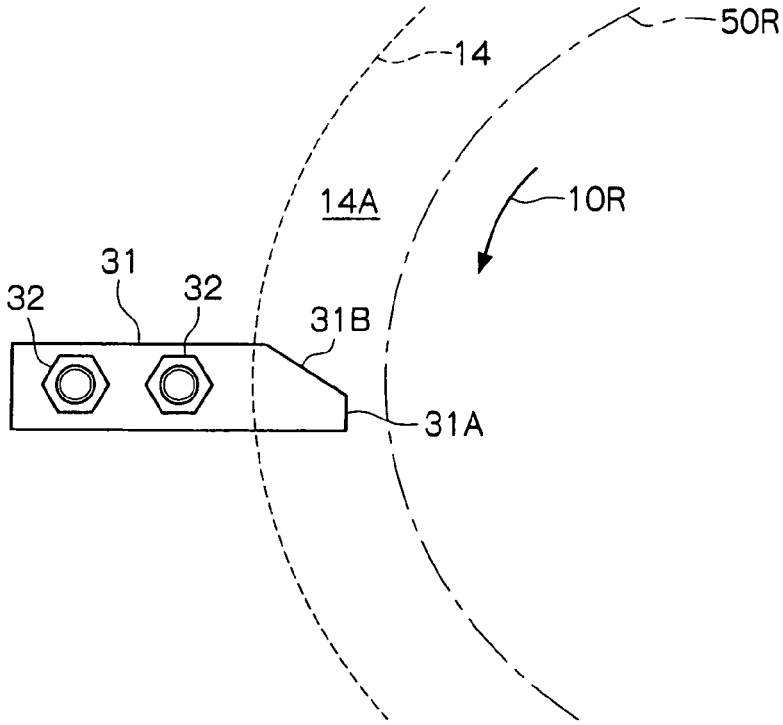

FIG. 3 is an explanatory view for explaining a substantial part of a suction device according to another embodiment of the present invention. FIG. 31A is a substantial part cross sectional view and FIG. 3B is a plan view of an entering regulation member. The same elements as the above-described embodiment are given the same reference numerals and marks and the explanation thereof is partially omitted. According to this embodiment, a crushing device 50 fitted to the driving axis 20 is mounted in the air intake opening 14A. The driving axis 20 drives the fan 10, so that the crushing device 50 is rotated in accordance with driving of the fan 10. The sucked object sucked up to the air intake opening 14A by a suction pressure generated by the rotational driving of the fan 10 is crushed due to the rotation of the crushing device 50. Then, the finely-crushed sucked object is guided into the air intake passage M in the fan case 14 passing through among the blades of the fan 10 as shown by an arrow to be blown from the air blowing opening 14B (not illustrated in FIG. 3) that is formed in a centrifugal direction of the fan 10.

According to this embodiment, the entering regulation part 30 does not cut or crush the sucked object such as a wood chip by itself, however, the entering regulation part 30 has a function to turn the sucked object intending to enter the gap G and return it into the air intake opening 14A which the crushing device 50 is rotated. Forming this entering regulation part 30 only in one place around the air intake opening 14A same as the above-described embodiment, a sufficient function can be obtained. However, within a scope that the suction performance of the fan 10 is not lowered, the entering regulation part 30 may be formed on plural places around the air intake opening 14A. If the entering regulation part 30 is formed on one place around the air intake opening 14A, the sucked object such as a wood chip to enter the gap G intend to enter the gap G while moving around the air intake opening 14A in accordance with rotation of the fan 10, so that the sucked object crushes into the entering regulation part 30 during movement so as to be turned within the air intake opening 14A. When the sucked object intending to enter the gap G is turned within the air intake opening 14A, this sucked object is provided with a crushing action of the crushing device 50 again. Therefore, during repeating this, the sucked object is finely crushed, and this makes it possible to avoid this sucked object from being sandwiched in the gap G.

In the case that the entering regulation part 30 is formed by the entering regulation member 31 same as the above-described embodiment, as shown in the drawing, by making the front end 31A to protrude into the air intake opening 14A, it is possible to further enhance the entering regulation effect. If the front end 31A of the entering regulation member 31 is made to protrude into the air intake opening 14A according to need, the sucked object such as a wood chip getting close to the gap G can be turned into the air intake opening 14A, so that entering of the sucked object into the gap G can be prevented in a former stage in advance. Thereby, a ratio that the sucked object is sandwiched in the gap G can be kept very low.

The entering regulation member 31 is characterized in that, even in the case that its front end 31A protrudes into the inside of the air intake opening 14A, the entering regulation member 31 is arranged so as not to intersect with a rotation trajectory 50R of the crushing device 50. In other words, it is not necessary for the entering regulation member 31 itself to have a blade at the front end and the side portion, so that the entering regulation member 31 has no function to cut or crush the sucked object in cooperation with the crushing device 50. For the rotating crushing device 50, by arranging the front end 31A separated from the crushing device 50 to some extent so as not to intersect with a rotation trajectory 50R of the crushing device 50, it is possible to avoid a disadvantage such that a pebble or the like is sandwiched between the crushing device 50 and the entering regulation member 31.

In other words, with respect to this entering regulation member 31, a safety mechanism that is necessary for the fixed cutter blade of the conventional art is not necessary at all. Accordingly, it is not necessary to provide the complex mechanism using a spring, so that maintenance is not needed and increase in a manufacturing cost of the device can be also prevented.

In addition, with respect to the entering regulation member 3, as same as the above-described embodiment, the turning part 31B directed toward the inside of the air intake opening 14A being opposed to a rotation direction of the fan 10 (an arrow 10R) may be formed on its front end 31A according to need. By forming this turning part 31B, an effect to prevent the sucked object from being sandwiched can be further enhanced. In other words, the sucked object such as a wood chip that crushes into the turning part 31B will be reliably turned into the rotating air intake opening 14A of the crushing device 50, so that the sucked object causing sandwiching of the sucked object can be effectively crashed to pieces. Thereby, the sucked object is likely guided to the suction path passing through among the wings of the fan 10 and it is possible to avoid the sucked object from being sandwiched in the gap G.

Figure 4:
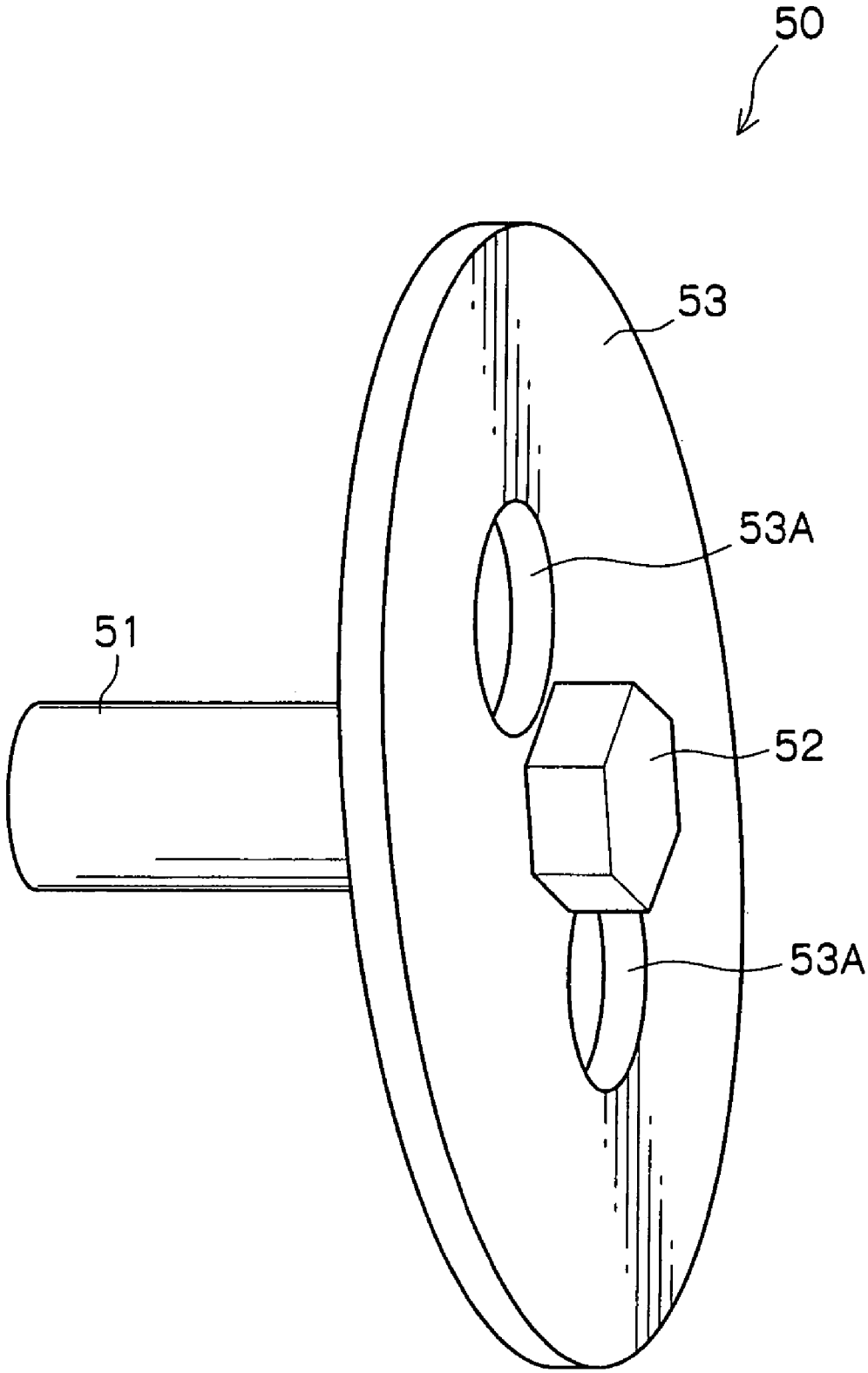
FIG. 4 is an explanatory view showing an example of a crushing device.

According to the embodiment shown in FIG. 3, the crushing device 50 may be the cutter 5 similar to that of the conventional art or may be other member to be rotated being fitted to the driving axis 20. FIG. 4 shows an example thereof and a disc body 53 is attached to the center of a support axis 51 to be fitted to the driving axis 20 by means of a fixing device 52. On the disc body 53, a plurality of openings 53A for forming the air intake path is formed according to need. The disc body 53 may be a circular form in a planar view or it may be formed in an ellipse shape or an oval shape in order to obtain an appropriate crashing function. In place of the disc body 53, a blade that is a rectangular blade in a planar view may be provided.

According to such an embodiment, the sucked object sucked up to the air intake opening 14A will be crashed due to rotation of the disc body 53 or rotation of the blade. In this case, the sucked object repeatedly receives the crushing action since the sucked object crushes into the surface of the disc body 53 and is turned. Therefore, more effective crushing action can be obtained.

As described above, according to the embodiment of the present invention, the entering regulation part 30 for regulating entering of the sucked object into a gap G between the inner wall of the fan case 14 and the fan 10 is formed on a part of the periphery of the air intake opening 14A. Therefore, if the sucked object intends to enter the gap G between the inner wall of the fan case 14 and the fan 10 from the air intake opening 14A, the sucked object is turned by the entering regulation part 30 to be returned into the air intake opening 14 again. Thereby, the sucked object directed toward the gap G can be guided to other suction path, so that it is possible to avoid the phenomenon such that the sucked object is sandwiched in the gap G. In addition, if the crushing device 50 is provided, crushing by means of this crushing device 50 to be rotated within the air intake opening 14A sufficiently acts. Thereby, the phenomenon such that the sucked object is sandwiched in the gap G can be further avoided.

In addition, by avoiding the phenomenon such that the sucked object is sandwiched in the gap G, a stable continuation of the operation of the suction device can be effected and it is possible to improve a durability of the device by preventing damages of the fan 10 and the fan case 14.

Further, the above-described phenomenon such that the sucked object is sandwiched in the gap G can be avoided without providing the fixed blade and the safety mechanism to be added to the fixed blade, so that it is possible to provide a safety suction device with an excellent maintenance performance and a low manufacturing cost.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A suction device for a powered vacuum apparatus, said suction device comprising:

a fan case which includes a front wall, a rear wall, an air inlet duct which merges with the front wall and provides an air inlet opening into the fan case, said air inlet opening defining a central axis, and an outlet duct, a fan which is mounted within said fan case to be rotatable about said central axis to suck an air stream into said fan case through said air inlet duct and direct said air stream towards said outlet duct, said fan including blades which define an annular gap with said front wall adjacent said inlet duct, and a generally rectangular regulator element which is attached by bolts to the front wall of said fan case so as to be positioned in and partially fill the annular gap between the front wall and the fan blades, said regulator element defining a longitudinal axis that extends towards said central axis and away from said rear wall of said fan case along a plane that intersects the central axis at an angle relative to a plane that is perpendicular to the central axis, said regulator element including a free end which extends into said air inlet duct to redirect objects away from said annular gap, said free end including a straight portion that is sloped relative to sides of the regulator element.

2. The suction device according to claim 1, wherein said fan includes a crushing device which is rotatable with said blades.

* * * * *